US005333960A

United States Patent [19]

Nam

[11] Patent Number: 5,333,960

[45] Date of Patent: Aug. 2, 1994

[54] DEVICE AND METHOD FOR DISPLAYING A RESIDUAL AMOUNT OF CARTRIDGE RIBBON FOR A COLOR VIDEO PRINTER

[75] Inventor: Joo H. Nam, Seoul, Rep. of Korea

[73] Assignee: SamSung Electronics Co., Ltd., Kyongki-Do, Rep. of Korea

[21] Appl. No.: 980,343

[22] Filed: Nov. 23, 1992

[30] Foreign Application Priority Data

Nov. 21, 1991 [KR] Rep. of Korea ..... 91-20768

[51] Int. Cl.[5] ..... B41J 35/36

[52] U.S. Cl. ..... 400/249; 400/207; 400/225; 400/703

[58] Field of Search ..... 400/207 E, 242, 246, 400/703, 225, 208, 223, 207, 249

[56] References Cited

U.S. PATENT DOCUMENTS 3,884,339 5/1975 Castoldi et al. ..... 400/246 X
4,747,716 5/1988 van der Eikel ..... 400/249
4,797,016 1/1989 Lahr ..... 400/225 X

FOREIGN PATENT DOCUMENTS 2742974 3/1979 Fed. Rep. of Germany ..... 400/225
0141580 6/1986 Japan ..... 400/225
1267086 10/1989 Japan ..... 400/242

*Primary Examiner*—Edgar S. Burr
*Assistant Examiner*—Christopher A. Bennett
*Attorney, Agent, or Firm*—Sughrue, Mion, Zinn, Macpeak & Seas

[57] ABSTRACT

A device for displaying a residual amount of cartridge ribbons in a color video printer. The rotational period of a supply reel or a take-up reel, is detected and the detected rotational period is compared with previously stored reference periods. A present residual amount is displayed based on the comparison so that a user can know how many more sheets can be printed with the ribbon cartridge.

7 Claims, 2 Drawing Sheets

DEVICE AND METHOD FOR DISPLAYING A RESIDUAL AMOUNT OF CARTRIDGE RIBBON FOR A COLOR VIDEO PRINTER

BACKGROUND OF THE INVENTION

1. Field of the Invention

The present invention relates to a device for displaying a residual amount of ribbon in a ribbon cartridge used for a color video printer which receives a video signal and outputs a hard copy.

2. Description of the Related Art

The cartridge ribbon of a color video printer prints a color image in accordance with a sublimating thermal transcribing system by forming three images from successively arranged yellow Y, magenta M and cyan C sections formed on a ribbon, in accordance with a video image signal of a television or the like. Generally, a number of ribbons, e.g., 50 ribbons are used to form a long ribbon tape and they are wound between a supply reel and a take-up reel within a ribbon cartridge. Each ribbon consists of a yellow, magenta and cyan section. During a printing operation, the unused ribbon wound on the supply reel is unwound from the supply reel, a printing operation is executed and then the used ribbon is wound on the take-up reel.

However, in a conventional color video printer, a user has no indication of the consumed state, i.e., the unused amount or consumed amount of the cartridge ribbons. Therefore, it is impossible to know how much more printing can be accomplished before a new cartridge is required. Accordingly, in the case where a spare cartridge is not readily available, the printing operation must be interrupted in order to obtain a new cartridge.

SUMMARY OF THE INVENTION

Therefore, an object of the present invention is to provide a ribbon residual amount displaying device capable of displaying the residual amount of ribbons in a cartridge to a user.

The above-described object is obtained by a residual ribbon displaying device for a ribbon cartridge having a detecting device for detecting rotation of a supply reel or a take-up reel, a memory having reference numbers stored therein indicating the period of supply reel rotations corresponding to the number of ribbons wound thereon, a comparing device for comparing the current period of a supply wheel rotation detected by the detecting device with the reference numbers, and a displaying device for displaying the amount of residual ribbons. The residual amount determination is based on the assumption that the feeding velocity of the cartridge ribbons is always constant and the ribbon winding diameter of the supply reel or the take-up reel wound with the ribbons is varied in accordance with the ribbon residual amount or the consumed amount. Accordingly, the rotational angular velocity of each reel is varied.

Of course, it is possible to obtain the object of the invention by detecting the ribbon consumption instead of the amount of residual ribbons.

DETAILED DESCRIPTION OF THE PREFERRED EMBODIMENT

Hereinafter, a preferred embodiment of the present invention will be described in detail with reference to the accompanying drawings.

Figure 1:
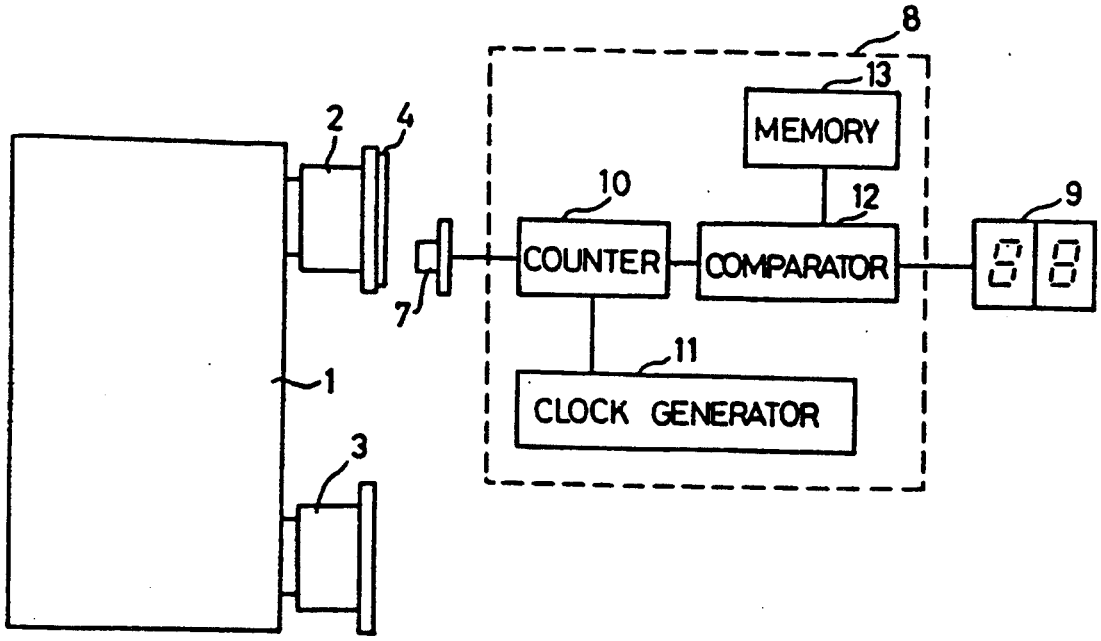
FIG. 1 is a block diagram of a cartridge ribbon residual display device in accordance with the present invention.
Figure 2:
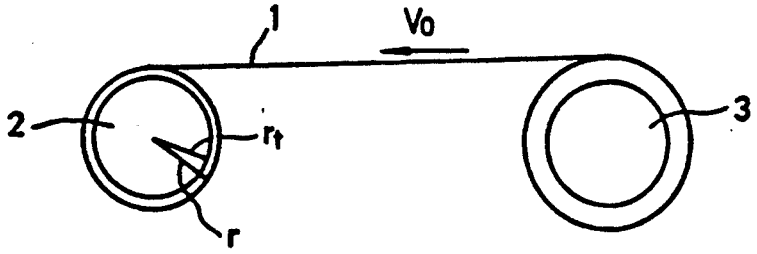
FIG. 2 is a schematic diagram for illustrating a determination of the ribbon residual amount.
Figure 4:
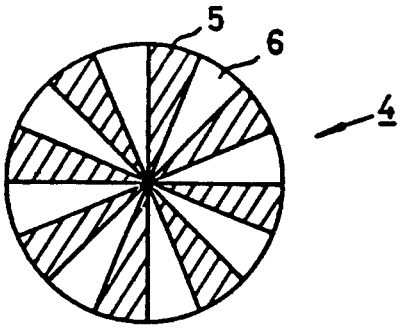
FIG. 4 is a diagram of a reflector used for detecting the rotational velocity of a reel.

FIG. i is a schematic diagram of a ribbon residual amount displaying device in accordance with a preferred embodiment of the present invention. An unused ribbon tape 1 is wound on a supply reel 3. The ribbon tape 1 will be unwound, as a take-up reel 2 rotates by virtue of a driving motor (not shown), and wound on the take-up reel 2 during a printing operation (see FIG. 2). As shown in FIG. 4, a reflector 4, having its face alternately divided, in radial sections, into unreflecting surfaces 5 and reflecting surfaces 6, is attached to the take-up reel 2. A photo-sensor 7 for emitting light of a predetermined wavelength, and receiving reflected light of the same wavelength, is mounted in opposition to the reflector 4. A processor 8 is connected to the photo-sensor 7. The processor 8 detects the rotation of the take-up reel 2, based upon the reflected light received by the photo-sensor 7 and compares the period of a full revolution thereof with reference values stored in memory 13 to calculate the residual amount of ribbons left on supply reel 3. The calculated ribbon residual amount is displayed on a 7-segment display 9.

Rotational detection of the take-up reel 2 is accomplished by the fact that the photo-sensor 7 receives pulses of the scanning light which is intermittently reflected from the reflector 4. The photo-sensor 7 converts the light pulses into an electrical pulse signal and transmits the signal to a counter 10 contained within the processor 8. The counter 10 counts the pulse signals from the photo-sensor 7 and simultaneously counts a reference clock pulse generated by a reference clock generator 11, and latches the clock pulse value at a time when the reel pulse signal reaches a predetermined counting number which corresponds to one full rotation of the take-up reel 2. The latched clock pulse value is the rotational period of the take-up reel 2.

A relationship between the calculated rotational period T and the ribbon residual amount is expressed as follows. First, a length L of the ribbon tape 1 wound on the take-up reel 2 is obtained by the following expression of the cross-sectional area of the ribbon tape 1 divided by its thickness:

$$L = \frac{\pi}{t_r}(r^2 - r_t^2)$$

Wherein $t_r$ is a thickness of the ribbon, r is a diameter of the take-up reel 2 with the ribbon wound thereon, and $r_t$ is a diameter of the take-up reel drum. Accordingly, the diameter r of the take-up reel 2 with the ribbon wound thereon becomes:

$$r = \sqrt{\frac{t_r}{\pi} L + r_t^2}$$

Assuming a linear velocity $V_0$ of the ribbon tape 1, during a printing operation is constant, since the diameter r of the take-up reel 2 is increased in response to the consumption of the ribbon 1, an angular velocity $\omega$ of the take-up reel 2 is varied. Therefore, the rotational period T of the take-up reel 2 can be expressed as follows.

$$T = \frac{2\pi}{\omega} = \frac{2\pi r}{V_0} = \frac{2\pi}{V_0}\sqrt{\frac{t_r}{\pi}L + r_t^2}$$

Figure 3:
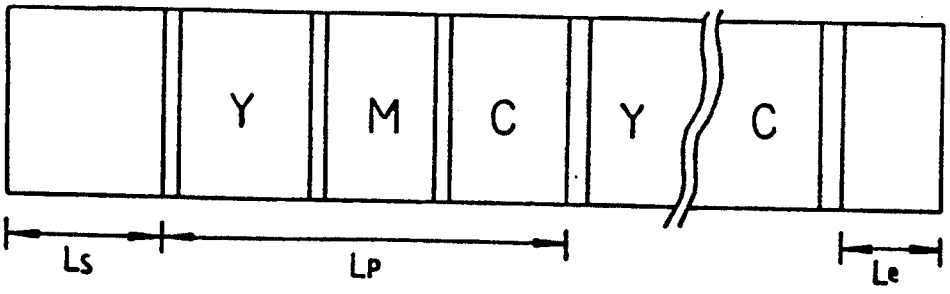
FIG. 3 is a diagram of a ribbon tape.

And, the ribbon length L wound on the take-up reel 2, which includes a consumed amount and an initial leader length $l_s$, can be expressed as:

$$L = l_p \times n + l_s$$

Wherein $l_p$ is a length of the ribbon used for printing one sheet, which consists of 1 section each of Y,M and C as shown in FIG. 3. And, n is the number of sheets printed and $l_s$ is an initial leader length.

Accordingly, a rotational period $T_n$ of the take-up reel 2 after n sheets has been printed is represented by the following expression:

$$Tn = \frac{2\pi}{V_o}\sqrt{\frac{t_r}{\pi}(l_p \times n + l_s + r_t^2)}$$

A relationship between the present rotational period Tn of the take-up reel 2 and the number of ribbons n on the take-up spool can be obtained from this expression. Accordingly, since a predetermined number of the ribbons 1 are originally wound on the supply reel 3 in the cartridge, the maximum possible printing number N can be previously determined, and the rotational period ($T_1$, $T_2$, $T_3$, . . . Tn) of the take-up reel corresponding to each consumed ribbon amount, or the residual ribbon amount, can be calculated from the above-described expression.

The calculated expected rotational period ($T_1$, $T_2$, $T_3$, . . . Tn) for each consumed ribbon amount is stored as values in a memory 13. A comparator 12 receives information from the counter 10 relating to the present rotational period Tn of the take-up reel 2, and compares this with the expected rotational period ($T_1$, $T_2$, $T_3$, . . . Tn) stored in the memory 13, and determines the present consumed ribbon amount based upon which of the expected rotational periods corresponds to the present rotational period. At this moment, the present rotational period may not be exactly equal to any of the expected rotational periods. In such a case, the amount of consumed ribbons can be calculated by rounding up, rounding down, using the closest value, or through any other appropriate manner.

When the residual number of ribbons or the consumed number of ribbons are determined by the comparator 12, the processor 8 generates an electrical control signal representative thereof, and outputs the control signal to an appropriate display device, e.g., to 7-segment display 9.

In the preferred embodiment, although the rotation is detected from the take-up reel 2, the same result can be obtained by detecting rotation of the supply reel 3 and calculating the values stored in memory 13 accordingly. Also, any display device may be used. Similarly, in order to detect the rotation of the take-up reel 2 or the supply reel 2, any known detecting device, such as an electromagnetic detector or an eddy current detector, can be used in place of the above-described photo-sensor.

Although the invention has been described through a preferred embodiment, it will be apparent to those skilled in the art that various modifications can be made without departing from the scope of the invention as defined by the appended claims.

I claim:

1. A device for displaying the residual amount of ribbons of a ribbon tape contained in a cartridge of color video printer in which a ribbon tape, constituted by a plurality of ribbons, for printing an image, on a sheet, in response to a video signal is disposed, comprising:

a supply reel and a take-up reel, said ribbon tape being wound between said supply reel and said take-up reel;

a detecting device coupled to one of said supply reel and said take-up reel so as to detect a rotational period of said one of said supply reel and said take-up reel;

a memory having values corresponding to reference rotational periods stored therein, each reference rotational period corresponding to a number of residual ribbons left on said supply reel;

comparing means for comparing a rotational period detected by said detecting device with the values corresponding to said reference rotational periods and determining a present residual amount of ribbons on said supply reel based on the comparison; and a display device for displaying said present residual amount of ribbons.

2. A displaying device as claimed in claim 1 wherein said detecting device is a photodetector.

3. A displaying device as claimed in claim 1, said detecting device comprising:

a light emitting device;

a reflector device coupled to said one of said supply reel and said take-up reel, said reflector rotating with said one of said supply reel and said take-up reel; and a light receiving device;

said light emitting device and said light receiving device being positioned so that light from said light emitting device intermittently strikes said reflector device and is directed to said light receiving device.

4. A displaying device as claimed in claim 1 wherein the reference rotational periods are calculated based upon the following equation:

$$Tn = \frac{2\pi}{V_o}\sqrt{\frac{t_r}{\pi}(l_p \times n + l_s + r_t^2)}$$

wherein;

Tn is a reference rotational period,

Vo is the linear velocity of said ribbon tape during printing, $t_r$ is the thickness of the ribbon tape, $l_p$ is the length of a ribbon used for printing one sheet, n is the number of sheets printed, $l_s$ is the length of a leader portion of the ribbon tape, and $r_t$ is the diameter of the drum of said one of said supply reel and said take-up reel.

5. A method of for detecting and displaying a residual amount of ribbons of a ribbon tape contained in a cartridge for a color video printer in which a ribbon tape, constituted by a plurality of ribbons, is wound between a supply reel and a take-up reel, said process comprising the steps of:

storing values in a memory, the values corresponding to reference rotational periods of one of said supply reel and said take-up reel, each reference rotational period corresponding to a number of residual ribbons left on said supply reel;

detecting the rotational period of said one of said supply reel and said take-up reel;

comparing the detected rotational period to the values stored in said memory and determining a number of residual ribbons based on said comparison;

displaying the number of residual ribbons.

6. A method as claimed in claim 5 further comprising the step of:

calculating the reference rotational periods based upon the following equation:

$$Tn = \frac{2\pi}{V_o} \sqrt{\frac{t_r}{\pi}(1_p \times n + 1_s + r_t^2)}$$

wherein;

Tn is a reference rotational period,

Vo is the linear velocity of said ribbon tape during printing, $t_r$ is the thickness of the ribbon tape.

$l_p$ is the length of a ribbon used for printing one sheet, n is the number of sheets printed, $l_s$ is the length of a leader portion of the ribbon tape, and $r_t$ is the diameter of the drum of said one of said supply reel and said take-up reel.

7. A device for displaying the residual amount of ribbons of a ribbon tape contained in a cartridge of color video printer in which a ribbon tape, constituted by a plurality of ribbons, for printing an image, on a sheet, in response to a video signal is disposed, comprising:

a supply reel and a take-up reel, said ribbon tape being wound between said supply reel and said take-up reel;

a detecting device coupled to one of said supply reel and said take-up reel so as to detect a rotational period of said one of said supply reel and said take-up reel;

a memory having values corresponding to reference rotational periods stored therein, each reference rotational period corresponding to a number of residual ribbons left on said supply reel, said reference rotational periods being calculated based upon the following equation;

$$Tn = \frac{2\pi}{V_o} \sqrt{\frac{t_r}{\pi}(1_p \times n + 1_s + r_t^2)}$$

wherein;

Tn is a reference rotational period,

Vo is the linear velocity of said ribbon tape during printing, $t_r$ is the thickness of the ribbon tape, $l_p$ is the length of a ribbon used for printing one sheet, n is the number of sheets printed, $l_s$ is the length of a leader portion of the ribbon tape, and $r_t$ is the diameter of the drum of said one of said supply reel and said take-up reel;

comparing means for comparing a rotational period detected by said detecting device with the values corresponding to said reference rotational periods and determining a present residual amount of ribbons on said supply reel based on the comparison; and a display device for displaying said present residual amount of ribbons.

* * * * *